United States Patent [19]

Dichiara

[11] 4,014,372

[45] Mar. 29, 1977

[54] BOTTLING MACHINE, FILLING VALVE BELL AND SEALING GASKET

[76] Inventor: Anthony J. Dichiara, 10 St. Paul's Crescent, Garden City, N.Y. 11530

[22] Filed: Sept. 8, 1975

[21] Appl. No.: 611,463

[52] U.S. Cl. ..... 141/392; 141/286; 239/DIG. 4

[51] Int. Cl.[2] ..... B65B 3/18

[58] Field of Search ..... 141/169, 198, 372, 392, 141/53, 59–61, 57, 58, 285–310, 311, 363, 324, 387, 383–386, 388, 389; 239/600, DIG. 4; 285/321, 30 S, DIG. 22

[56] References Cited

UNITED STATES PATENTS

| | | | |
|---|---|---|---|
| 3,207,190 | 9/1965 | Silbereis et al. | 141/198 |
| 3,742,989 | 7/1973 | Campbell et al. | 141/16 S |

*Primary Examiner*—Houston S. Bell, Jr.
*Attorney, Agent, or Firm*—E. Janet Berry; Lawrence Rosen

[57] ABSTRACT

In machines for filling bottles, liquid passes into a bottle past filling valve sealing sleeve and air exits through a vent tube; the filling valve retainer carries an annular rubber gasket that seals against the lip of the bottle to prevent leakage as the bottle fills; a centering bell is carried on the filling valve retainer and extends over the neck of the bottle; the sealing gasket is secured in the centering bell and the gasket is removed from the filling valve retainer by the removal from the retainer of the centering bell; the centering bell is held to the filling valve retainer by resilient snap-in means.

33 Claims, 6 Drawing Figures

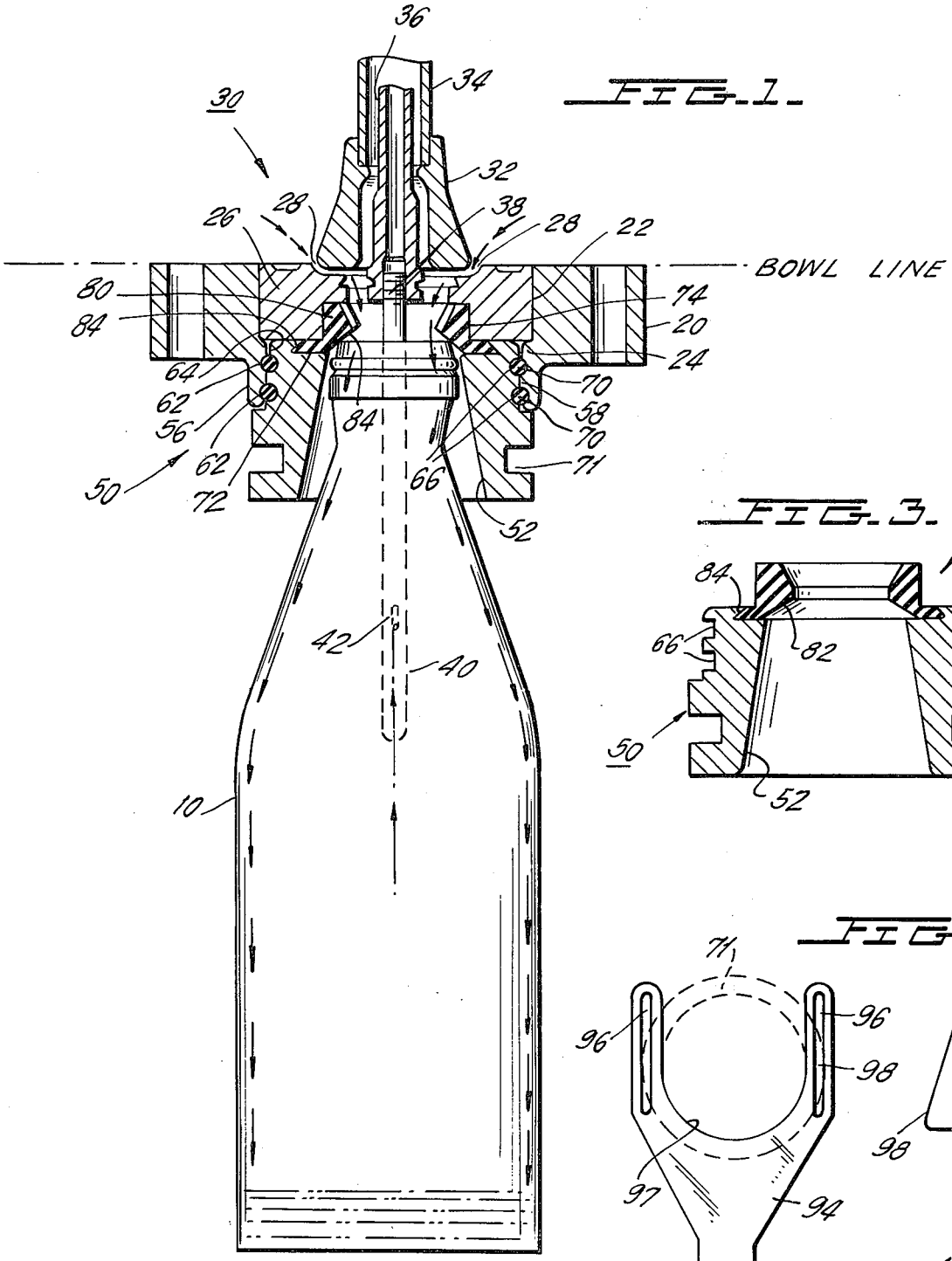
FIG. 1
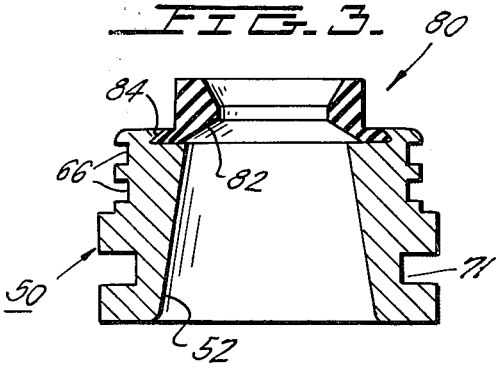
FIG. 3
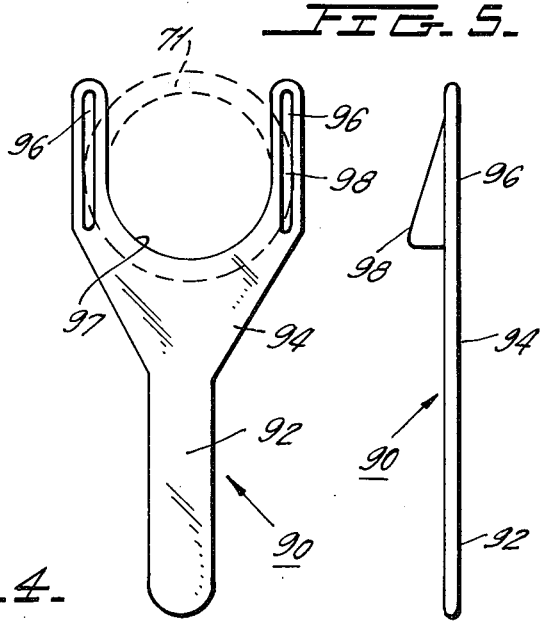
FIG. 5
FIG. 4

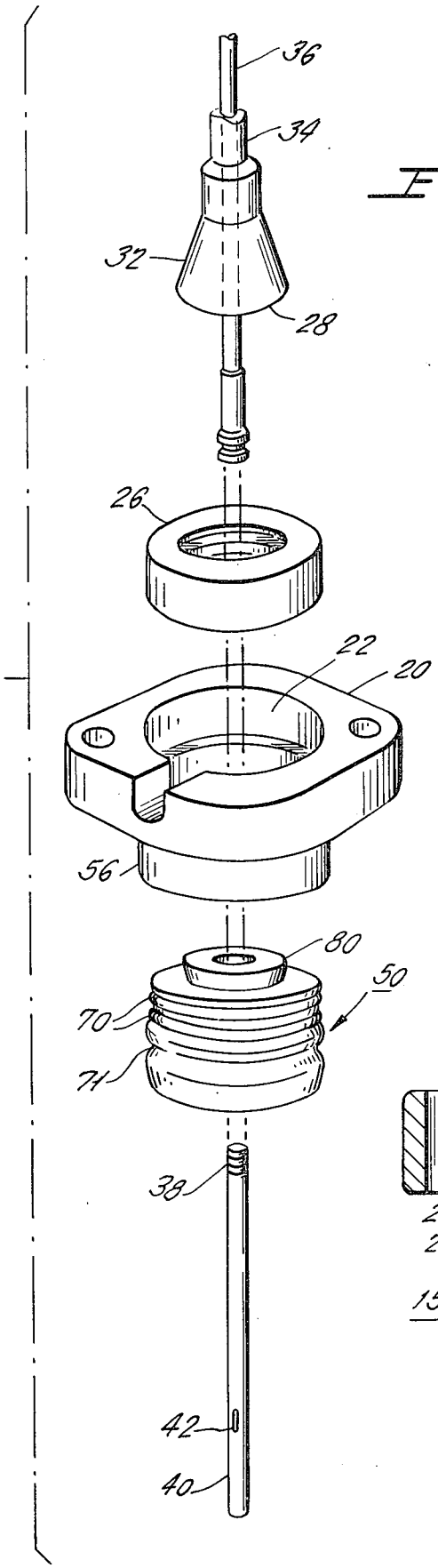
FIG. 2.
FIG. 6.
(PRIOR ART)
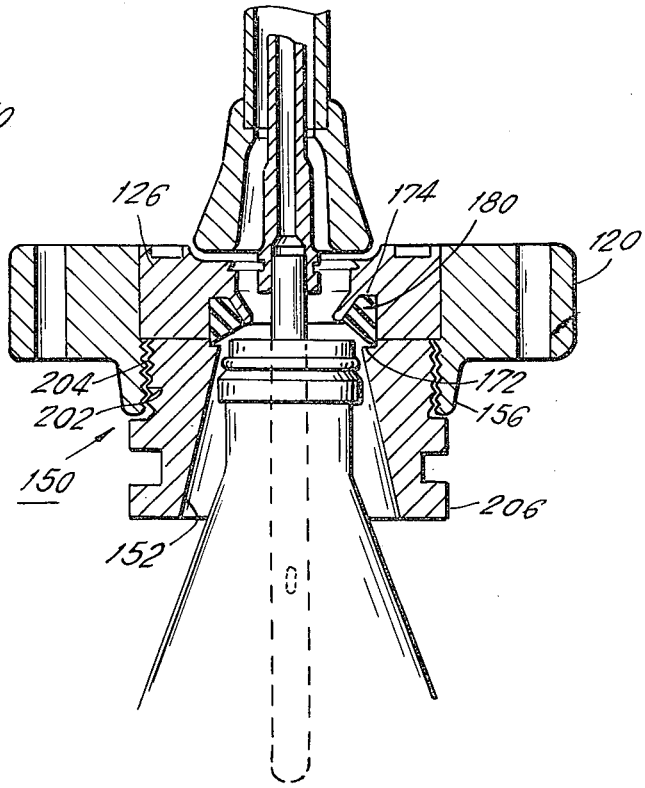

BOTTLING MACHINE, FILLING VALVE BELL AND SEALING GASKET

BACKGROUND OF THE INVENTION

The present invention relates to bottle filling apparatus in general and to the bottle centering bell and inflow sealing gasket of a bottle filling assembly, in particular.

Automatic bottle filling apparatus must provide for entry without leakage of the liquid to placed in the bottle and simultaneous removal of air from the bottle. In a bottle filling apparatus, the empty bottle is moved to a location at which means for filling the bottle is attached to it. The means for filling the bottle includes a centering bell which fits over the lip and neck of the bottle and shifts the bottle to center it beneath the filling means. Above the centering bell is a bottle lip sealing gasket which is pressed against the lip of the bottle and seals it against leakage while the bottle is being filled with liquid. Both the sealing gasket and the centering bell are supported in a retainer which is raised and lowered off the bottle. Feeding into the bottle, through and past the retainer and the sealing gasket, are liquid inlets. Means direct the liquid from a supply tank, reservoir, or the like through these inlets into the bottle. A vent communicates with the bottle as it is being filled to vent the air being displaced by the inflowing liquid.

After the bottle has been filled, the retainer is raised off the bottle and this lifts off the sealing gasket, centering bell and filling valve and assembly.

Occasionally, bottles being filled break or chip and particles of glass adhere to the sealing gasket, e.g., because that gasket is wet, or the particles mar the surface of the gasket. In addition, through use, there is a dirt and bacterial build-up on the gasket and/or the centering bell. For sanitary and other reasons, therefore, it is necessary to periodically remove the centering bell, to possibly clean it and to periodically replace the bottle sealing gasket with an uncontaminated and unmarred one. To encourage replacement of bottle sealing gaskets at the proper intervals and to minimize down time on bottle sealing apparatus, it is desirable that the removal of the centering bell for gaining access to the bottle sealing gasket and replacement of the bottle sealing gasket be as simple and rapid as possible.

DESCRIPTION OF THE PRIOR ART

The conventional centering bell is screw threaded on its exterior surface and the filling valve retainer is cooperatingly internally threaded, such that the bell may be screwed into the retainer. The centering bell beneath the retainer is appropriately profiled, e.g., hexagonally shaped, for cooperting with a removal means, such as a wrench, by which the centering bell is removed. Such removal of the bell gives acess to the hidden sealing gasket, but does not remove the gasket. An operator must now reach into the confined opening beneath the retainer and in a separate action, he must extract the used gasket, replace this with a new gasket and then rescrew the centering bell into the retainer.

One further problem with a bottle sealing gasket arises due to the frequently high filling pressures in the bottle apparatus and due to the gasket being pressed against the lip of the bottle during filling. Through use, the gasket becomes jammed into the filling bottle retainer, making extraction of the sealing gasket more difficult after the gasket has been used for prolonged periods.

Most major soft drink companies require the removal of a centering bell every time a bottle breaks on a particular valve and also require periodic removal of the centering bell and sealing gasket for cleaning and sanitizing. However, due to the excessive time and difficulty involved in removing conventional centering bells, bottle filling apparatus operators frequently do not remove the bells and gaskets at all or do so at undesirably infrequent intervals, contributing to contamination of the soft drinks by bacteria and contributing to the presence of fragments of glass in subsequently filled bottles.

BRIEF DESCRIPTION OF THE INVENTION

In accordance with the invention, the centering bell is snap fastened into the centering bell retainer, instead of being screwed into it. Both the bell receiving opening in the retainer and the periphery of the bell are annular in shape and are provided with cooperating O-ring receiving grooves. Resilient O-rings carried in the grooves of the bell permit the snap in, snap out mounting of the bell.

Because the centering bell is snapped out and into its receiving opening in the retainer, the removal and insertion of the bell can be done quite rapidly, does not require time consuming tightening and loosening operations and an operator is more willing to remove the snap in centering bell as required.

Joinder means hold the bell and the sealing gasket together. At the upper end of the vertical opening through the bell and thus at the top of the bell, an undercut groove is formed. The sealing gasket located at the top of the bell has a cooperating external peripheral flange which extends into the undercut groove in the bell, thereby defining the joinder means. When the retainer and bell are separated, because of the undercut groove and the resilience of the gasket, the gasket is retained in the groove in the bell and is withdrawn with the bell from the retainer. Thereafter, the gasket can be easily snapped out of its retaining groove in the centering bell and a new gasket can be snapped into this retaining groove. Although the embodiment just described has the groove in the bell and the flange on the gasket, it is apparent that the groove may be in the gasket and the flange on the bell. Because the gasket has stayed with the bell upon bell removal, rather than the gasket remaining in the retainer and because the gasket has a portion that normally projects above the top of the bell, the removal and replacement of the gasket is so easy that operators are encouraged to replace the gasket as required.

The exposed portion of the periphery of the bell beneath the retainer is provided with appropriate means for receiving a tool that extracts the bell from the retainer. In one embodiment, the periphery of the bell carries an annular groove. An extraction tool is fitted into this groove and extraction is performed by the tool drawing out the bell.

Accordingly, it is the primary object of the present invention to provide an easily removed and replaced centering bell and bottle filling sealing gasket for a bottle filling apparatus.

It is another object of the invention to provide an improved centering bell for such an apparatus.

It is a further object of the invention to provide an improved bottle lip sealing gasket for such an apparatus.

It is a further object of the invention to ease the removal and emplacement of the centering ball and/or the bottle sealing gasket of a bottle filling apparatus.

It is another object of the invention to cause the centering bell and bottle sealing gasket to be removable and emplaceable together in such a bottle filling apparatus.

These and other objects of the invention will become apparent from the following description and accompanying drawings.

BRIEF DESCRIPTION OF THE DRAWINGS

FIG. 1 is a cross-sectional elevational view of a bottle and a bottle filling assembly incorporating the features of the invention;

FIG. 2 is an exploded perspective view of some of the elements of the assembly that are shown in FIG. 1;

FIG. 3 is a cross-sectional elevational view of a bell and gasket assembly incorporating features of the invention;

FIG. 4 is a plan view of an extraction tool used with the invention;

FIG. 5 is a side elevational view of the extraction tool of FIG. 4; and

FIG. 6 is a fragmentary view, of the type in FIG. 1, showing the prior art.

DETAILED DESCRIPTION OF A PREFERRED EMBODIMENT OF THE INVENTION

FIGS. 1 and 2 show a bottle filling assembly according to the invention that is included in a larger bottle filling apparatus having a number of these assemblies. The bottle 10 is to be filled with liquid. By conventional conveyor means, manual means, or the like (not shown), the bottle is brought to a station for filling. The device which fills the bottle 10 comprises the valve 20, 26, 30, centering bell 50, sealing gasket 80 and retainer 20.

Retainer 20 is rigid and may be comprised of metal. The retainer 20 is anchored to the tank or bowl which holds the liquid that is fed through below described liquid inlet 28. A circular opening 22 defined by annular side walls passes vertically through the retainer 20. At the lower end of the opening 22 is a filling valve annular seat 24 on which the filling valve is seated. Positioned in the opening 22 and seated on the seat 24 is the body 26 of the filling valve. The filling valve 26 is an annular ring having a plurality of spaced, annularly arrayed liquid inlet openings 28 passing through it, through which the liquid to be placed in the bottle 10 passes. Between the spaced openings 28, the valve body 26 is attached to the supporting sheath 32 of the vent tube assembly 30. The sheath 32 is attached to the extension 34 over the vent tube 36.

The valve 26 and the valve seal 32 are comprised of metal, plastic, rubber or any other sufficiently rigid material that has been approved for use in connection with edible liquids by the Food and Drug Administration. By means of the connection between the sheath 32 and the main valve assembly 36, a unitary liquid flow control and valve assembly has been created.

Within the sheath 32, 34 is supported the main vent tube 36. The vent tube 36 is a normally unremoved fixture. Attached by screw thread connection 38 to the end of the vent tube 36 is the hollow vent tube extension 40 with its inlet 42. As the bottle is filled with liquid, the vent tube extension 40 is contacted and obviously eventually will be contaminated by the liquid. Through the use of a separable extension 40, the permanent vent tube need not be changed. Only its liquid contacting extension 40 need be changed. As liquid enters the bottle 10, the air displaced by the liquid exits through the vent 42, 36.

For properly positioning the bottle beneath the inlet 28, the centering bell 50 is provided. The bell 50 is an annular unit comprised of high molecular weight steel, stainless steel or any other Food and Drug Administration approved material.

A generally frusto-conically shaped, tapered annular opening 52 extends vertically through the centering bell and is defined by annular side walls. The slope of the taper of the side walls of opening 52 gradually aligns the bottle 10 beneath the inlet 28 as the bottle 10 and bell 50 are moved together. The slope is selected so that the bottle will be caused to shift if it is misaligned and is also selected so that the neck or body of the bottle will not interfere with the settling of the bell over the bottle.

It is the manner in which the bell 50 is fastened to the retainer 20 that is one of the significant features of the invention. The retainer 20 has a depending bell supporting sleeve 56, with an internal opening 58 that is defined by annular side walls for sealingly receiving the bell 50. The walls of the sleeve opening 58 have at least one and preferably a plurality of annular grooves 62 formed therein each for receiving an O-ring or other snap fit sealing means, as described below.

The annular periphery or external side walls of the bell at 64 generally conforms to the internal walls 58 of sleeve 56, thereby to generally seal the bell in the sleeve. In the external walls 64 of the bell 50 are defined at least one and more usually a corresponding number of annular grooves 66 each of which aligns with the respective one of the grooves 62 in the sleeve 56 when the bell 50 is emplaced in the sleeve 56.

The cooperating grooves 62, 66 are intended to retain respective O-rings 70, as shown in FIG. 1. The O-rings 70 are comprised of hard, resilient neoprene rubber or other Food and Drug Administration approved resilient material. Upon removal and emplacement of bell 50 in retainer sleeve 56, the O-rings 70 remain with the bell 50. In an alternate arrangement, the O-rings may remain with the grooves 62 in the retainer. The rings are snapped out of the grooves 62 by drawing the bell outwardly from retainer 20 and are snapped into the grooves 62 by pushing the bell into the opening 58 in the retainer. The cooperating walls 58, 64 might be very gradually tapered narrower upwardly to facilitate insertion and withdrawal.

Near the upper end of the centering bell 50, its internal walls 52 have an annular, undercut groove or recess 72 defined in them. The recess is for holding the below described sealing gasket 80 to the centering bell as the bell is removed from the retainer 20. At its lower, internal end portion, the valve element 26 is provided with an annular recess 74 that is shaped to receive and sealingaly contain below described sealing gasket 80. Recess 74 tapers gradually wider toward its downwardly facing entrance opening so that the gasket 80 could be easily inserted into and removed from the recess 74, without resistance to such movement.

Gasket 80 is an annular open center gasket comprised of neoprene rubber or another resilient Food and Drug Administration approved material. As shown in FIGS. 1 and 3, the gasket is shaped to fit into the recess 74 in valve retainer 20. The gasket 80 widens from the bottom of recess 74 out to its bottle lip contracting surface 82. Surface 82 is slanted as shown in FIG. 1 so that as the bottle 10 and retainer 20 move together, secure engagement between the bottle and the sealing gasket 80 is assured. The squeezing together of the bottle and sealing gasket ensure the liquid seal and preclude liquid leaking down the outside of the bottle. As shown in FIG. 3, gasket 80 flares outward slightly around its exterior. This facilitates holding of gasket 80 in recess 74.

Removal of bell 50 from retainer 20 can be by any means. In accordance with the below described technique, an extractor 90 is applied to the bell to remove it. On the exterior surface of the lower exposed portion of the bell 50 is defined an annular groove 71 which is shaped to receive the below described tool 90. The tool is forced into the recess 71 and is then shifted to snap the bell out of the retainer.

At the lower end of the gasket 80, below its sloping contact surface 82, the gasket includes an outwardly projecting annular flange 84 which is shaped to fit into and which sits in the undercut recess 72 into the wall 52 of the bell 50. In effect, therefore, the gasket becomes part of the bell 50 with respect to removal and emplacement of the bell in the retainer 20. As shown in FIGS. 2 and 3, because of the connection of the gasket 80 at the top of the bell 50, when the bell 50 is removed from retainer 20, the gasket has its upper end portion exposed. This resilient, perhaps rubber, gasket can be deformed to remove it from the bell 50 and replace the gasket with a substitute, clean undamaged gasket.

In the prior art, due to the pressures of the gasket against successive bottles and due to the filling pressures, the bottle sealing gasket became jammed against the valve body in the equivalent of recess 74. Removal of a jammed gasket was quite difficult. Applicant's connecting the gasket and bell greatly simplifies removal and the gasket jamming now presents no problem.

In an alternate embodiment, the gasket 80 and bell 50 can be integrally formed or molded in a single unit of neoprene rubber, or the like. Obviously, in this situation, when replacement of the gasket becomes necessary, the entire bell-gasket assembly would have to be replaced.

FIGS. 4 and 5 show the extractor tool 90 that is emplaceable in the groove 71 for removing the bell. Extractor tool 90 has a handle 92 leading to a main body 94. From the body project two arms 96 which are joined by the body 94. The body 94 includes the semicircular web 97 having an internal diameter substantially equal to the external diameter of the interior of recess 71. The tool 90 is forced into the groove 71. As more clearly shown in FIG. 5, each arm 96 carries an upstanding tool locking projection 98 which is gradually tapered taller so that as the tool is inserted into the groove 71, the lock projections 98 securely and nonremovably hold the tool 92 to the bell 50 to ease extraction of the bell. Of course, once the bell has been removed, the tool is separated from the bell.

FIG. 6 shows a typical bell and gasket assembly as now available in the prior art. The bell 150 illustrated there has an internal structure quite similar to that of bell 50. Where corresponding structures are identified in FIGS. 1 and 6, they are correspondingly numbered, with the reference numerals in FIG. 6 being raised by 100. Bell 150 differs from bell 50 in that the upper portion of bell 150 carries a screw thread 202. The interior surface of depending sleeve 156 of retainer 120 carries a cooperating screw thread 204, whereby the bell 150 is screwed into and out of the retainer 120. To facilitate screwing in and out of the bell 150, its exposed lower end portion is shaped, e.g., hexagonal nut shaping 206, in a manner to enable a tightening tool, such as a wrench, to be applied to the nut 206. It has been found that the effort of screwing in and out bell 150 has caused workers to defer replacement of bell 150 and of sealing gasket 180 although sanitary and contamination circumstances warrant the removal and replacement. The invention so eases removal and replacement of the bell as to no longer discourage this when it is required.

In bell 150, instead of being undercut, the gasket receiving recess 172 is substantially squared off at the upper interior corner of the bell. The gasket 180 is an annular ring and, as shown in FIG. 6, its external periphery is straight walled, without any outwardly projecting flange. The gasket 180 simply sits in the recess 172. After bottle filling, the gasket 180 becomes jammed in the retainer recess 174. Removal of the bell 150 does not affect the gasket 180. After removal of the bell 150, the gasket is still hidden in the retainer 120. Removal of the hidden, jammed in gasket 180 from the retainer 120 is difficult. It is hard to find a part of gasket 180 that can be grabbed and held, and an operator may, therefore, delay removal of the gasket, omit its removal when this is necessary and take an unduly long time to remove the gasket when he finally does this.

The bottle filling apparatus of the invention as described above is, of course, part of a much larger apparatus which handles a number of bottles simultaneously and may be filling more than one of them at one time. Automatic plural bottle filling apparatus are well known in the prior art and a typical complete assembly incorporating the invention is, therefore, not described herein.

Although the present invention has been described in connection with a preferred embodiment thereof, many variations and modifications will now become apparent to those skilled in the art. It is preferred, therefore, that the present invention be limited not by the specific disclosure herein, by only by the appended claims.

I claim:

1. A bottle filling apparatus comprising; a bottle filling valve assembly, a bottle centering bell and a bottle lip sealing gasket;

said bottle filling valve assembly comprising: a retainer element; liquid flow passage means communicating through said retainer element; a liquid inlet valve in said retainer element flow passage means; said flow passage means and said valve being shaped so as to direct liquid passing through and past them into a bottle positioned beneath said flow passage means;

said bell being located beneath said retainer element and beneath said flow passage means; said bell comprising a body having a first opening therethrough, and first side walls defining said first opening; said first side walls being shaped such that said bell is able to pass over a bottle placed in said first opening and said first side walls being so positioned and shaped as to direct a bottle whose upper end is in said first opening to be beneath said flow passage means;

cooperating snap fastening means on said bell and said retainer element for holding said bell beneath said retainer element and for enabling snap-in connection and disconnection of said bell and said retainer element;

said bottle lip sealing gasket being positioned and adapted for engaging the lip of a bottle whose upper portion is in said bell first opening; said gasket being located in said first opening of said bell; means in at least one of said bell and said retainer element for supporting said gasket.

2. The bottle filling apparatus of claim 1, wherein said gasket and said bell have mutual joinder means for holding said bell and said gasket together against separating upon removal of said bell from said retainer element.

3. The bottle filling apparatus of claim 2, wherein said joinder means comprise a groove in said bell and a projection from said gasket extending into said groove such that by its said projection, said gasket is drawn away from said retainer element upon extraction of said bell from said retainer element.

4. The bottle filling apparatus of claim 3, wherein said groove is located in said bell first side walls and is located near the top end of said bell nearer said retainer element; said gasket being of a height to have a portion that extends above said bell when said gasket projection is in said groove.

5. The bottle filling apparatus of claim 4, wherein said retainer element has a recess that faces downwardly toward said gasket and into which said recess extends said portion of said gasket that is above said retainer element.

6. The bottle filling apparatus of claim 1, wherein said retainer element has a second opening extending into it which is defined by second side walls; said bell being inserted into said second opening; said bell having external third side walls that are opposed to said second side walls when said bell is inserted into said retainer element;

said snap fastening means being carried on said second and third side walls, whereby upon insertion of said bell into said retainer element said second opening, said snap fastening means fasten together.

7. The bottle filling apparatus of claim 6, wherein said second and third side walls are oriented generally along the direction in which said bell is inserted and removed from said second opening;

said snap fastening means in said second side walls comprise at least a first groove formed therein and said snap fastening means in said third side walls comprise at least a second groove formed therein;

resilient means carried in one of said first grooves and said second groove and snapped into and out of the other of said first and said second grooves.

8. The bottle filling apparatus of claim 7, wherein said second and said third side walls and said first and said second groove are all annular and said resilient means is an O-ring.

9. The bottle filling apparatus of claim 7, wherein said gasket and said bell have mutual joinder means for holding said bell and said gasket together against separating upon removal of said bell from said retainer element.

10. The bottle filling apparatus of claim 9, wherein said joinder means comprise a third groove in said bell and a projection from said gasket extending into said third groove such that by its said projection, said gasket is drawn away from said retainer element upon extraction of said bell from said retainer element.

11. The bottle filling apparatus of claim 10, wherein said third groove is located in said first side walls and is located near the top end of said bell and toward said retainer element; said gasket being of a height to have a portion that extends above said bell when said gasket projection is in said third groove;

said retainer element has a recess that faces downwardly toward said gasket and into which said recess extends said portion of said gasket that is above said retainer element.

12. A bottle filling apparatus comprising: a bottle filling valve assembly, a bottle centering bell and a bottle lip sealing gasket;

said bottle filling valve assembly comprising: a retainer element; liquid flow passage means communicating through said retainer element; a liquid inlet valve in said retainer element flow passage means; said flow passage means and said valve being shaped so as to direct liquid passing through and past them into a bottle positioned beneath said flow passage means;

said bell being located beneath said retainer element and beneath said flow passage means; said bell comprising a body having a opening therethrough, and side walls defining said opening; said side walls being shaped such that said bell is able to pass over a bottle placed in said opening and first side walls being so positioned and shaped as to direct a bottle whose upper end is in said opening to be beneath said flow passage means;

cooperating fastening means on said bell and on said retainer element for holding said bell beneath said retainer element;

a bottle lip sealing gasket positioned in said opening and adapted for engaging the lip of a bottle whose upper end is located in said opening; said gasket and said bell having mutual joinder means for holding said bell and said gasket together against separating upon removal of said bell from said retainer element.

13. The bottle filling apparatus of claim 12, wherein said joinder means comprise a groove in said bell and a projection from said gasket extending into said groove such that by its said projection, said gasket is drawn away from said retainer element upon extraction of said bell from said retainer element.

14. The bottle filling apparatus of claim 13, wherein said groove is located in said bell side walls and is located near the top end of said bell and nearer said retainer element; said gasket being of a height to have a portion that extends above said bell when said gasket projection is in said bell groove.

15. The bottle filling apparatus of claim 14, wherein said retainer element has a recess that faces downwardly toward said gasket and into which said recess extends said portion of said gasket that is above said retainer element.

16. For use in a bottle filling apparatus, a bottle centering bell and sealing gasket assembly:

said bell comprising a body having a vertical opening extending therethrough and internal side walls defining said opening; said internal side walls being shaped such that said bell opening can be placed over the upper end of a bottle and being so shaped that a bottle whose first end is in said opening is directed toward engagement with said gasket;

said gasket comprising a bottle lip sealing gasket that is positioned in said opening of said bell and that is adapted for engaging the lip of a bottle whose upper end is in said opening; receiving means in said bell for supporting said gasket;

said bell having external side walls that are oriented generally along the length of said bell and generally coaxially with said opening of said bell;

snap fastening means carried on said external side walls for engaging cooperating means on an object into which said bell external side walls are inserted for snap fastening said bell to that said object.

17. The centering bell and sealing gasket assembly of claim 16, wherein said snap fastening means in said bell external side wall comprise at least one groove formed therein for receiving and supporting resilient means.

18. The centering bell and sealing gasket assembly of claim 17, wherein resilient means is carried in said groove in said bell external side walls.

19. The centering bell and sealing gasket assembly of claim 18, wherein both said bell side walls and said groove therein are annular; said resilient means comprise an 0-ring carried in said groove.

20. The centering bell and sealing gasket assembly of claim 17, wherein said gasket and said bell have mutual joinder means for holding said bell and said gasket together against separation.

21. The centering bell and sealing gasket assembly of claim 20, wherein said joinder means comprise a second groove in said bell and a projection from said gasket that extends into said second groove such that by means of its said projection, said gasket is drawn and moved along with said bell to which it is joined.

22. The centering bell and sealing gasket assembly of claim 21, wherein said second groove is located in said internal side wall of said bell near the top end of said bell; said gasket being of a height to have a portion that extends above said bell when said gasket projection is in said second bell groove.

23. For use in a bottle filling apparatus, a bottle centering bell and sealing gasket assembly:

said bell comprising a body having a vertical opening extending therethrough and internal side walls defining said opening; said internal side walls being shaped such that said bell opening can be placed over the upper end of a bottle and being so shaped that a bottle whose first end is in said opening is directed toward engagement with said gasket;

said gasket comprising a bottle lip sealing gasket that is positioned in said opening of said bell and that is adapted for engaging the lip of a bottle whose upper end is in said opening; receiving means in said bell for supporting said gasket;

said gasket and said bell having mutual joinder means for holding said bell and said gasket together against separation.

24. The centering bell and sealing gasket assembly of claim 23, wherein said joinder means comprise a groove in said bell and a projection from said gasket that extends into said groove such that by means of its said projection, said gasket is movable along with said bell to which it is joined.

25. The centering bell and sealing gasket assembly of claim 23, wherein said groove is located in said internal side wall of said bell and near the top end of said bell; said gasket being of a height to have a portion that extends above said bell when said gasket projection is in said second bell groove.

26. In combination, the bottle filling apparatus of claim 7 and removal means for removing said bell from said retainer;

said bell having removal means receiving means on itself for receiving removal means;

said removal means being engageable with said removal means receiving means on said bell such that upon engagement of said removal means and said removal means receiving means, said bell can be removed by said removal means.

27. The combination of claim 26, wherein said removal means receiving means on said bell comprises a groove formed into the periphery of said bell and said removal means comprises a tool insertable into said groove on the exterior of said bell.

28. In combination, the centering bell and sealing gasket assembly of claim 17 and removal means for removing said bell from said retainer;

said bell having removal means receiving means on itself for receiving removal means;

said removal means being engageable with said removal means receiving means on said bell such that upon engagement of said removal means and said removal means receiving means, said bell can be removed by said removal means.

29. The combination of claim 28, wherein said removal means receiving means on said bell comprises a second groove formed into the periphery of said bell and said removal means comprises a tool insertable into said second groove on the exterior of said bell.

30. For use in a bottle filling apparatus, a bottle centering bell; said bell comprising a body having a vertical opening extending therethrough and internal side walls defining said opening; said internal side walls being shaped such that said bell opening can be placed over the upper end of a bottle and being so shaped that a bottle whose first ends is in said opening is directed toward engagement with said gasket;

said bell having external side walls that are oriented generally along the length of said bell and generally coaxially with said opening of said bell;

snap fastening means carried on said external side walls for engaging cooperating means on an object into which said bell external side walls are inserted for snap fastening said bell to that said object;

said bell having removal means receiving means on itself for receiving removal means.

31. The centering bell of claim 30, wherein said snap fastening means in said bell external side wall comprise at least one groove formed therein for receiving and supporting resilient means; resilient means is carried in said groove in said bell external side walls.

32. In combination, the centering bell of claim 31 and removal means for removing said bell from a retainer;

said removal means being engageable with said removal means receiving means on said bell such that upon engagement of said removal means and said removal means receiving means, said bell can be removed by said removal means.

33. The centering bell of claim 31, further comprising a gasket receiving groove for receiving a flange from a gasket and being formed in said internal side walls near the top of said vertical opening.

* * * * *